US011309109B2

(12) United States Patent
Delette

(10) Patent No.: US 11,309,109 B2
(45) Date of Patent: Apr. 19, 2022

(54) INDUCTIVE CORE EXHIBITING LOW MAGNETIC LOSSES

(71) Applicant: COMMISSARIAT A L'ENERGIE ATOMIQUE ET AUX ENERGIES ALTERNATIVES, Paris (FR)

(72) Inventor: Gerard Delette, Grenoble (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 725 days.

(21) Appl. No.: 16/062,693

(22) PCT Filed: Dec. 16, 2016

(86) PCT No.: PCT/EP2016/081390
§ 371 (c)(1),
(2) Date: Jun. 15, 2018

(87) PCT Pub. No.: WO2017/103077
PCT Pub. Date: Jun. 22, 2017

(65) Prior Publication Data

US 2018/0374620 A1 Dec. 27, 2018

(30) Foreign Application Priority Data

Dec. 17, 2015 (FR) ..... 15 62599

(51) Int. Cl.
*H01F 21/00* (2006.01)
*H01F 3/10* (2006.01)
(Continued)

(52) U.S. Cl.
CPC ..... *H01F 3/10* (2013.01); *H01F 3/14* (2013.01); *H01F 27/22* (2013.01);
(Continued)

(58) Field of Classification Search
CPC ... H01F 3/10; H01F 3/14; H01F 27/22; H01F 2003/103; H01F 2003/106
(Continued)

(56) References Cited

U.S. PATENT DOCUMENTS 4,104,787 A * 8/1978 Jandeska ..... H01F 1/0557 148/103
4,544,904 A * 10/1985 Tarachand ..... H01F 7/021 252/62.57
(Continued)

FOREIGN PATENT DOCUMENTS

CN 103035360 A 4/2013
CN 106104718 A 11/2016
(Continued)

OTHER PUBLICATIONS

Japanese Office Action dated Aug. 24, 2020 in Japanese Patent Application No. 2018-531624 (with English translation), 12 pages
(Continued)

*Primary Examiner* — Alexander Talpalatski
*Assistant Examiner* — Joselito S. Baisa
(74) *Attorney, Agent, or Firm* — Oblon, McClelland, Maier & Neustadt, L.L.P.

(57) ABSTRACT

An inductive core including a body including a ferromagnetic material and a magnet, the magnet forming a first path for circulating of magnetic flux lines produced by the magnet, and the ferromagnetic material at least partially forming a second path for circulating the magnetic flux lines, wherein the ferromagnetic material extends continuously between the poles of the magnet along the poles of the magnet and makes contact with at least a part of an exterior lateral wall of the magnet extending between its poles.

23 Claims, 4 Drawing Sheets

(51) Int. Cl.

| | |
|---|---|
| ***H01F 3/14*** | (2006.01) |
| ***H01F 41/02*** | (2006.01) |
| ***H01F 27/22*** | (2006.01) |
| *H01F 38/02* | (2006.01) |

(52) U.S. Cl.
CPC ... *H01F 41/0246* (2013.01); *H01F 2003/103* (2013.01); *H01F 2003/106* (2013.01); *H01F 2038/026* (2013.01)

(58) Field of Classification Search
USPC ..... 336/61, 110, 212
See application file for complete search history.

(56) References Cited

U.S. PATENT DOCUMENTS

| | | | | |
|---|---|---|---|---|
| 5,821,844 | A | 10/1998 | Tominaga et al. | |
| 5,926,083 | A * | 7/1999 | Asaoka | H01F 3/10 336/110 |
| 6,236,125 | B1 * | 5/2001 | Oudet | H02K 33/16 310/12.26 |
| 6,388,896 | B1 * | 5/2002 | Cuk | H02M 3/1582 363/16 |
| 6,621,398 | B2 * | 9/2003 | Fujiwara | H01F 3/10 148/300 |
| 6,856,231 | B2 * | 2/2005 | Fujiwara | H01F 1/0552 336/233 |
| 6,980,077 | B1 * | 12/2005 | Chandrasekaran | H01F 27/255 336/212 |
| 7,800,474 | B2 * | 9/2010 | Yabumi | H01F 7/02 336/110 |
| 8,940,816 | B2 | 1/2015 | Servant et al. | |
| 9,030,282 | B2 * | 5/2015 | Pieteris | H01F 37/00 336/110 |
| 9,293,247 | B2 * | 3/2016 | Friebe | H01F 7/0205 |
| 9,384,887 | B2 * | 7/2016 | Leyland | A63H 33/26 |
| 9,978,491 | B2 * | 5/2018 | Ota | H01F 17/043 |
| 2002/0030574 | A1 | 3/2002 | Sato | |
| 2002/0159277 | A1 | 10/2002 | Matsumoto et al. | |
| 2002/0190830 | A1 | 12/2002 | Matsumoto et al. | |
| 2004/0168303 | A1 * | 9/2004 | Matsumoto | H01F 3/10 29/607 |
| 2004/0207500 | A1 | 10/2004 | Fujiwara et al. | |
| 2009/0072934 | A1 | 3/2009 | Cartier Millon et al. | |
| 2010/0271157 | A1 * | 10/2010 | Talon | H01F 7/1646 335/229 |
| 2015/0077206 | A1 * | 3/2015 | Leyland | H01F 38/14 336/110 |
| 2015/0179323 | A1 | 6/2015 | Uemoto et al. | |
| 2016/0086756 | A1 * | 3/2016 | Bang | H01F 7/1615 361/160 |
| 2017/0236630 | A1 * | 8/2017 | Kank | H01F 7/1646 335/230 |

FOREIGN PATENT DOCUMENTS

| | | | |
|---|---|---|---|
| EP | 1 187 150 | A1 | 3/2002 |
| EP | 1 187 151 | A1 | 3/2002 |
| EP | 1 209 703 | A2 | 5/2002 |
| EP | 2 879 139 | A1 | 6/2015 |
| EP | 3 125 259 | A1 | 2/2017 |
| JP | 47-44017 | A | 12/1972 |
| JP | 4-97315 | U | 8/1992 |
| JP | 5-47572 | A | 2/1993 |
| JP | 5-55065 | A | 3/1993 |
| JP | 7-226326 | A | 8/1995 |
| JP | 8-316049 | A | 11/1996 |
| JP | 9-283353 | A | 10/1997 |
| JP | 2002-83722 | A | 3/2002 |
| JP | 2002-208526 | A | 7/2002 |
| JP | 3314908 | B2 | 8/2002 |
| JP | 2002-289443 | A | 10/2002 |
| JP | 2002-359127 | A | 12/2002 |
| JP | 2003-7519 | A | 1/2003 |
| JP | 2003-7542 | A | 1/2003 |
| JP | 2003-059727 | A | 2/2003 |
| JP | 2003-68535 | A | 3/2003 |
| JP | 2003-338414 | A | 11/2003 |
| JP | 2004-55734 | A | 2/2004 |
| JP | 2005-294698 | A | 10/2005 |
| JP | 2010-56237 | A | 3/2010 |
| JP | 2014-27050 | A | 2/2014 |
| JP | 2015-185673 | A | 10/2015 |
| WO | WO 2012/088641 | A1 | 7/2012 |
| WO | WO 2014/042525 | A1 | 3/2014 |
| WO | WO 2014/132066 | A1 | 9/2014 |
| WO | WO 2015/147064 | A1 | 10/2015 |

OTHER PUBLICATIONS

Combined Chinese Office Action and Search Report dated May 6, 2021 in Chinese Patent Application No. 201680074564.7 (with English translation). 25 pages International Search Report dated Apr. 19, 2017 in PCT/EP2016/081390 filed Dec. 16, 2016.

French Search Report dated Nov. 7, 2016 in FR 1562599 filed Dec. 17, 2015.

* cited by examiner

INDUCTIVE CORE EXHIBITING LOW MAGNETIC LOSSES

TECHNICAL FIELD AND PRIOR ART

The present invention relates to an inductor core for producing inductors particularly for the manufacture of passive components in the field of power electronics, notably at high frequencies comprised for example between 100 kHz and 10 MHz.

An inductor comprises a core and an electrical conductor arranged according to n turns around a part of the core. The core is constituted of a ferromagnetic material characterised by a relative magnetic permeability μ. In operation, an alternating electric current flows through the turns generating a magnetic induction of same frequency in the core.

Such an inductor is for example used in a power converter, which is an electronic device that has the function of adapting the voltage and current delivered by an electrical power source to supply, according to the specifications, a distribution network or a given electrical system.

The converter comprises electronic components operating as switches (active components) switching at a given frequency. In the case of DC/DC converters for example, the active components are transistors that are used to "cut" the input voltage according to regular cycles. In order to deliver a continuous voltage in output, inductors are used to store and discharge the electrical energy at each cycle and to smooth out the output voltage to its average value. These so-called "passive" elements are indispensable in the operation of converters, but they can represent up to 40% of the volume and the cost of the converter.

Converters operating at high frequency may be produced, for example above 1 MHz thanks to the use of the material GaN which makes it possible to produce transistors that can switch at very high frequency. In theory, the rise in frequency is particularly interesting because it would make it possible to reduce the volume of the passive components of converters and thus their size, the weight and the cost of these devices. Indeed, by increasing the chopping frequency, the number of electrical cycles increases and thereby the energy transferred by the magnetic core over a given time increases in the same proportion. Since the power of the converter remains constant, it is theoretically possible to reduce the volume of magnetic inductors in a manner inversely proportional to the frequency.

Yet inductors compatible with operation at frequencies comprised between 100 kHz and 10 MHz have inductance values comprised between 1 μH and 10 mH. The most suitable inductors are monolithic inductors made of ferromagnetic material. This material is characterised by a relative magnetic permeability $\mu_r$>50 and an induction $B_S$>100 mT.

Ferrite type oxide materials with spinel crystallographic structure have stable permeability values at high frequency. For this reason, they are very widely used as inductor cores, notably for operations at high frequency comprised between 100 kHz and 10 MHz. The most common formulations are ($Mn_{1-x}Zn_xFe_2O_4$) and ($Ni_{1-x}Zn_xFe_2O_4$). These materials are also characterised by high electrical resistivity values limiting losses by induced currents.

Yet these ferromagnetic materials are prone to energy dissipation processes, also called magnetic losses. These magnetic losses are dissipated in the form of heat at all points of the volume of the core.

Furthermore, a current in the turns creates a magnetic field and a variable induction of same frequency as that of the current comprising a continuous component and a variable component.

The peak value of the variable induction may be written:

$$\hat{B} = B_{DC} + \frac{\Delta B}{2}$$

With $B_{DC}$ the continuous component and ΔB/2 is the average between the two extrema of the variable component.

Yet magnetic losses increase with frequency and with the peak value of the magnetic induction.

One technique for reducing magnetic losses is then to reduce the peak value of the magnetic induction.

A first solution consists in generating a magnetic polarisation by circulating a continuous current around the core. The intensity of the continuous current is determined by application of the Ampere theorem in such a way as to create a constant induction value and of sign opposite to the continuous component $B_{DC}$ set by the converter. Such a solution is described in the document U.S. Pat. No. 6,388,896. This solution has a certain size and a certain additional cost. For example, for cores of small dimensions, space is not always available for producing the additional coils.

A second solution consists in generating a magnetic polarisation by means of magnets inserted in a zone of the core or arranged against one face of the core. The magnets are arranged in such a way as to make the magnetic flux circulate in the core in the direction opposite to the magnetic flux corresponding to the continuous component $B_{DC}$.

The documents EP 1187150 and EP 1187151 A1 describe such a solution. The magnet(s) generate a magneto-driving force enabling the circulation of the magnetic flux in the whole of the magnetic circuit.

This solution is efficient for inductors operating at low frequency and for materials of high relative magnetic permeability for example above 500. In this case, the whole of the magnetic flux produced by the magnet remains confined in the core and flux losses are low.

On the other hand, magnetic materials that could operate at frequencies above 1 MHz, such as NiZn ferrites, are characterised by permeability values less than 100. In this case, the magnetic circuit is subject to magnetic leakages at the level of the magnets, a part of the flux lines produced by each magnet directly loops back from one pole to the other of the magnet by passing through the surrounding medium without flowing through the whole of the magnetic circuit. The magnetic polarisation efficiency is thus altered and the value of the continuous component of the induction is not reduced efficiently. In addition, the magnetic flux lines radiate in the environment of the core, which can affect the operation of other components of the converter.

DESCRIPTION OF THE INVENTION

The aim of the present invention is thus to offer an inductor core suited to the production of inductors capable of operating at high frequency, for example >1 MHz, and exhibiting reduced magnetic losses.

The aforementioned aim is attained by an inductor core comprising a ferromagnetic material and at least one permanent magnet. The ferromagnetic material edges at least partially the magnet so as to extend continuously along the lateral wall of the magnet between its two poles. Due to the arrangement of the ferromagnetic material along the magnet between the poles, the magnetic flux lines coming out of the pole N of the magnet circulate in the ferromagnetic material up to the pole S. A homogeneous polarisation of the ferromagnetic material by the magnet is then ensured. It is then possible to compensate partially or totally the continuous component of the induction in a more homogeneous manner in the core. Magnetic losses are then reduced efficiently.

When a current flows in the winding, the core is the seat of two magnetic circuits, in one flows the magnetic flux lines produced by the winding and in the other flows the magnetic flux lines generated by the magnet(s). The flux lines flow in opposite directions.

In other words, the ferromagnetic material is arranged as near as possible to the magnet between its poles on the natural path of the magnetic flux lines produced by the magnet when they loop back from the north pole to the south pole. The flux lines are thus easily "collected". The shortest path is thereby created for the magnetic flux lines produced by the magnet between the north pole and the south pole, which produce a homogenous magnetic flux in the ferromagnetic material. Since the magnetic flux produced by the magnet loops back directly in the ferromagnetic material, it does not radiate or radiates little towards the exterior, the operation of the other components is thus little or not perturbed. The invention is thus suited to an implementation in inductors of which the ferromagnetic material has a low magnetic permeability, for example less than 100, and particularly suited to an operation at high frequency.

In an exemplary embodiment, the ferromagnetic material surrounds the entire lateral surface of the magnet between the two poles.

Advantageously, the dimension of the magnet between its two poles is substantially equal to the magnetic length of the core, i.e. the dimension of the ferromagnetic material. Leakages are then low.

In another very advantageous exemplary embodiment, the core comprises several magnets arranged with respect to each other such that the poles of opposite polarities of two successive magnets are facing, and the ferromagnetic material extends continuously between all the magnets. The flux lines then circulate from one magnet to the other and loop back between the north pole of the final magnet of the succession of magnets and the south pole of the first magnet of the succession of magnets.

For example, the core is of type E and comprises a central bar provided with an air gap, the magnetic fluxes forming two loops that close up in the central bar. The magnets in the form of a bar are at least partially buried in the straight parts of the core and extend over practically the entire length of the straight parts.

The magnetic flux lines produced by the magnet(s) loop back in the body of the core in a direction opposite to the magnetic flux lines due to the polarisation of the core by the coil. The polarisation thereby generated partially compensates, preferably totally compensates, the continuous component of the induction generated by the circulation of the current in the conductor of the inductor.

Preferably, non-magnetic zones are arranged at the level of two poles of two magnets following each other in order to avoid a looping back of the magnetic flux lines before they have passed through the entire length of the magnetic circuit.

Advantageously, the non-magnetic zones comprise cavities passing through the core, said cavities also serve to evacuate heat to the exterior surface of the core. The cavities are for example filled with air, and in a very advantageous manner, are filled with a good heat conducting, electrically insulating and non-magnetic material such as AlN.

The present invention then relates to an inductor core for magnetic inductor, comprising a body comprising a ferromagnetic material and one or more magnets, in which the magnet(s) at least partially form a first path for circulating magnetic flux lines produced by the magnet(s) such that the first path comprises at one end a south pole, designated end south pole, and at another end a north pole, designated end north pole, and in which the ferromagnetic material at least partially forms a second path for circulating said magnetic flux lines, in which the ferromagnetic material extends continuously from the south pole to the north pole along the magnet(s) and comprising, facing the end south pole, a non-magnetic zone and, facing the end north pole, a non-magnetic zone forcing the magnetic flux lines coming out of the end north pole to take the second path and to loop back on the end south pole, said non-magnetic zones being designated "end non-magnetic zones", such that a transversal section of the inductor core, perpendicular to the flux lines comprises both the first path for circulating and the second path for circulating.

Preferably, the magnetic flux lines of the first path circulate in a direction opposite to that of the magnetic flux lines circulating in the second path.

In an exemplary embodiment, each magnet comprises an exterior lateral face between the south pole and the north pole, the ferromagnetic material being in contact with a part at least of the exterior lateral surface of each magnet.

The south pole and the north pole of the first path may belong to a single magnet.

Advantageously, the ferromagnetic material completely surrounds the exterior lateral surface of the magnet, said inductor core comprising two end faces comprising for one the south pole and ferromagnetic material and for the other the north pole and ferromagnetic material, each end face being facing a non-magnetic zone designated end non-magnetic zones. The ferromagnetic material may form a sleeve receiving the magnet and in contact with the exterior surface of the magnet and in which the distance between the poles of the magnet and the magnetic length of the core are equal or substantially equal, the end non-magnetic zones being formed by air.

In another exemplary embodiment, the south pole and the north pole of the first path belong to distinct magnets, the magnets being arranged such that the poles of opposite polarities of two successive magnets are facing or substantially facing. The poles facing two magnets are advantageously connected by zones of ferromagnetic material.

For example, the body comprises at least one non-magnetic zone, designated intermediate non-magnetic zone, at the level of each zone of ferromagnetic material separating the poles facing two magnets so as to prevent the magnetic flux lines coming out of a north pole of a magnet from looping back directly to the south pole of said magnet without preventing the magnetic flux lines from passing from one pole to the other of two successive magnets.

Each intermediate non-magnetic zone may comprise a cavity. The cavity may emerge in opposite exterior faces of the body.

In an advantageous exemplary embodiment, the cavity is filled with a heat conducting and electrically insulating material, for example AlN.

The body comprises a given thickness and said magnets may extend over the entire thickness of the body.

In an exemplary embodiment, the body comprises a rectangular frame and a central bar arranged transversally with respect to the sides of the frame of longest length and parallel to the sides of the frame of smallest length. Two first paths are delimited in the frame and in the central bar in a symmetrical manner with respect to a plane of symmetry passing through the central bar and perpendicular to a mean plane of the frame and two second paths are delimited in the frame and in the central bar in a symmetrical manner with respect to said plane of symmetry. The central bar comprises an air gap.

The central bar may comprise at least two magnets belonging to the two first paths.

For example, each side of long length comprises two magnets of same length and each side of small length comprising one magnet, and in which the central bar comprises a magnet on each side of the air gap, such that the two first paths each comprise five magnets.

The air gap may be arranged between the end south pole and the end north pole and form the end non-magnetic zones.

Advantageously, the magnet(s) is or are of bonded type comprising at least one powder magnetic material dispersed in a matrix made of electrically insulating material.

For example, the ferromagnetic material has a permeability less than 100.

The ferromagnetic material may be a spinel ferrite selected from NiZn and MnZn.

The present invention also relates to an inductor comprising an inductor core according to the invention and a conductor wound around at least a part of the core.

The present invention also relates to a converter comprising at least one electronic component and at least one inductor according to the invention.

The present invention also relates to a method for manufacturing an inductor core according to the invention, comprising the steps of:

a) Supplying at least one magnet, b) Manufacturing a body made of ferromagnetic material by injection moulding from a feedstock comprising at least one ferromagnetic powder and organic matter, so as to arrange at least one cavity for the mounting of the magnet in the body, c) Mounting the magnet in the cavity.

During step b), at least one cavity may advantageously be produced to form a non-magnetic zone.

The method may comprise a step of putting in place a non-magnetic, non-electrically conducting and heat conducting material in the cavity forming the non-magnetic zone.

During step a), the magnet is advantageously a bonded magnet. The magnet may be produced by moulding a mixture of at least one magnetic powder and a polymer matrix.

Step b) may comprise a sub-step of moulding the feedstock, a sub-step of debinding and a sub-step of heat treatment.

The sub-step of heat treatment advantageously takes place directly after the sub-step of debinding by increasing the temperature with respect to that of the debinding.

The present invention also relates to another method for manufacturing an inductor core according to the invention, comprising the steps of:

a') Supplying at least one magnet, b') Manufacturing a body made of ferromagnetic material by over-moulding on the magnet.

BRIEF DESCRIPTION OF THE DRAWINGS

The present invention will be better understood on the basis of the description that follows and the appended drawings in which.

DETAILED DESCRIPTION OF PARTICULAR EMBODIMENTS

The inductor core according to the invention implements one or more permanent magnets, but in the interest of simplicity the remainder of the description will use uniquely the term "magnet" to designate a permanent magnet.

Figure 1A:
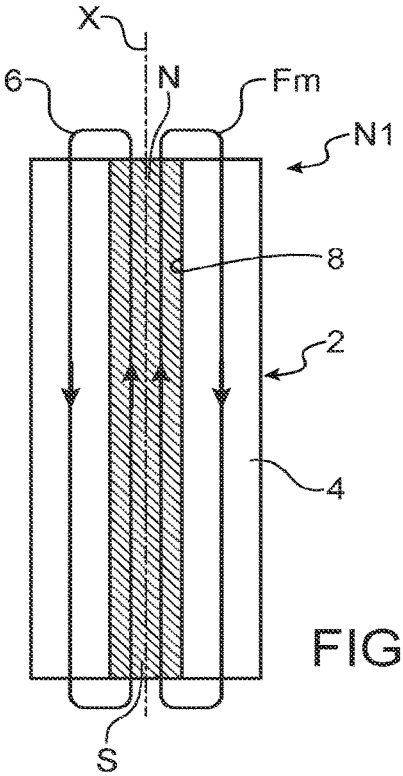
FIG. 1A is a view in longitudinal section of an inductor core according to an exemplary embodiment.
Figure 1B:
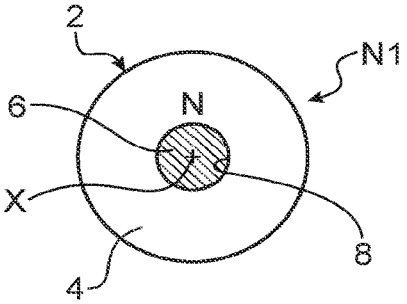
FIG. 1B is a transversal sectional view of the core of FIG. 1A.

In FIGS. 1A and 1B may be seen an exemplary embodiment of an inductor core N1 according to the invention comprising a body 2 of cylindrical shape of longitudinal axis X with circular section, and a magnet 6. The body 2 comprises a ferromagnetic material 4. The body has an annular section and delimits within it a cavity 8 of longitudinal axis X. The shape and the section of the core are not limiting, for example a body of square section falls within the scope of the present invention.

The core is advantageously monolithic, i.e. moulded in a single part.

The magnet 6 extends longitudinally along the X axis and has a circular section. The south S and north N poles of the magnet are situated at the level of the longitudinal ends of the magnet 6. The exterior diameter of the magnet 6 corresponds to the interior diameter of the cavity 8, such that the magnet can be arranged in the cavity 8 and is in contact with the ferromagnetic material 6. The length I1 of the magnet is at least equal to the length I2 of the ferromagnetic material. In the example represented, the length I1 of the magnet is substantially equal to the length I2 of the ferromagnetic material.

It will be noted that, in this case, the zones of reversal of the magnetic flux situated naturally in line with the poles of the magnet are on the exterior of the ferromagnetic material so as to enable a rectilinear flow of the flux in the core.

The ferromagnetic material 4 then surrounds the magnet 6 over its entire length and over its entire circumference. Moreover, in the example represented, the magnet is in contact with the magnet over its entire circumference. But an embodiment in which the magnet could not be in contact with the ferromagnetic material does not go beyond the scope of the present invention.

The magnet produces magnetic flux lines Fm. On account of the relative arrangement of the poles of the magnet and the ferromagnetic material, the magnetic flux lines circulate from the south pole S to the north pole N in the magnet 6 then, thanks to the ferromagnetic material surrounding the magnet and extending between the pole S and the pole N, they loop back in the ferromagnetic material to the pole S.

The direction of the magnetic flux lines in the ferromagnetic material is opposite to that of the flux lines in the magnet.

All the ferromagnetic material is then polarised in a uniform manner by the magnet.

When the core N1 is used to produce an inductor, a conductor (not represented) is wound around the core. The conductor is for example made of copper and comprises for example n turns of longitudinal axis X.

A current flows in the conductor, which generates a magnetic field in the core and thus magnetic flux lines.

By choosing either the direction of circulation of the current of the conductor, or the orientation of the polarity of the magnet, the magnetic flux lines generated by the magnet and those generated by the conductor circulate in opposite directions. By choosing furthermore the value of the magnetic field of the magnet, it generates a polarisation that is going to reduce and advantageously cancel the continuous component of the induction generated by the current circulating in the conductor.

The peak value of the induction is written:

$$\hat{B} = B_{DC} + \frac{\Delta B}{2} \quad \text{(I)}$$

With $B_{DC}$ the continuous component and $\Delta B/2$ is the average between the two extrema of the variable component.

By cancelling $B_{DC}$ thanks to the magnet, the peak value is then equal to $\Delta B/2$, its value is thus reduced.

Yet, since magnetic losses are proportional to the peak value of the induction, said losses are reduced as well as thermal losses.

The structure of the core, in particular the relative arrangement of the ferromagnetic material and the magnet, makes it possible to ensure a looping back of the magnetic flux lines in the ferromagnetic material even in the case where the ferromagnetic material has a low permeability, for example less than 100. Indeed, the ferromagnetic material is arranged around the magnet on the natural passage of the magnetic flux lines produced by the magnet and looping back from the north pole to the south pole. Thus, the polarisation of the ferromagnetic material by the magnetic flux does not require a specific device, for example polar parts, acting on the flux lines to guide them in the ferromagnetic material. They loop back from the north pole to the south pole of the magnet over the entire length of the ferromagnetic material and do so in a homogeneous manner, even with materials having low permeability.

Moreover, in the example represented, the ferromagnetic material advantageously surrounds the entire magnet, the magnetic flux lines looping back in a symmetrical manner around the axis of the magnet, the majority of the magnetic flux lines are confined within the ferromagnetic material and the ferromagnetic material is polarised in a homogeneous manner.

As a variant, it could be provided that the ferromagnetic material does not completely surround the magnet and only extends for example over an angular portion of the lateral surface of the magnet between the two poles. The ferromagnetic material of the core would then still be polarised entirely in a uniform manner, the peak value would then be reduced. However, a fraction of the magnetic flux of the magnet could leak into the surrounding medium.

Figure 2A:
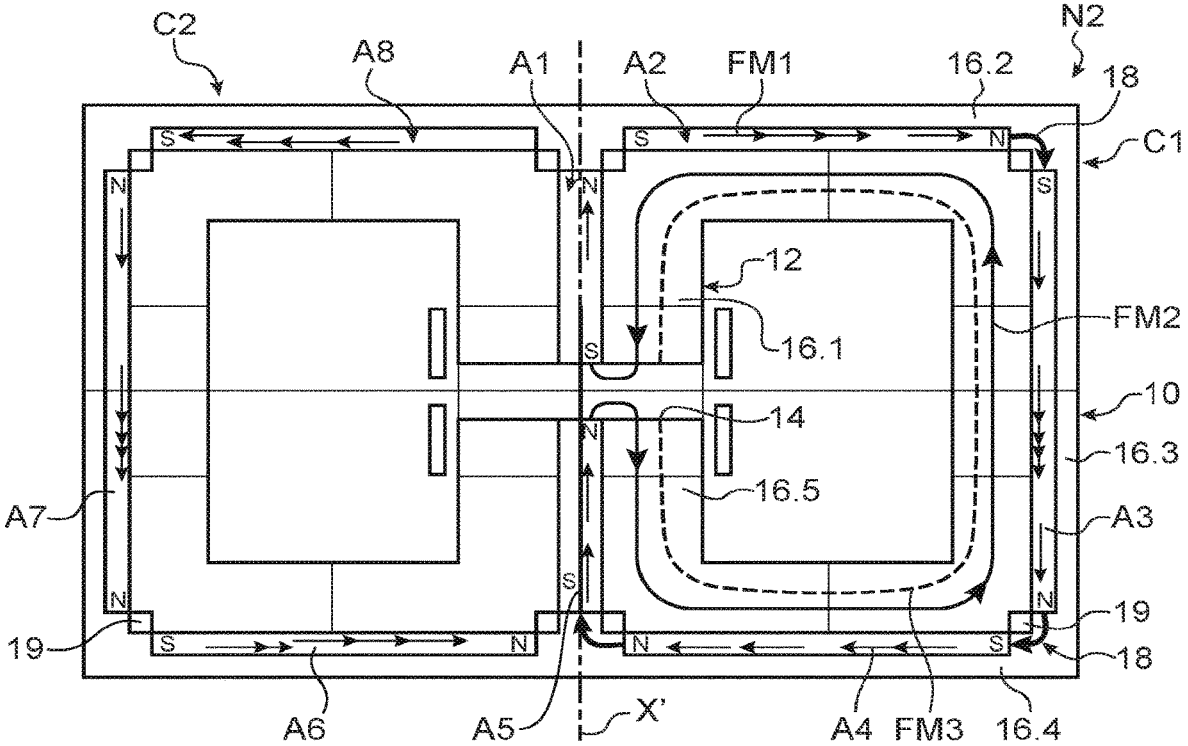
FIG. 2A is a schematically represented top view of an inductor implementing an inductor core according to another exemplary embodiment.
Figure 2B:
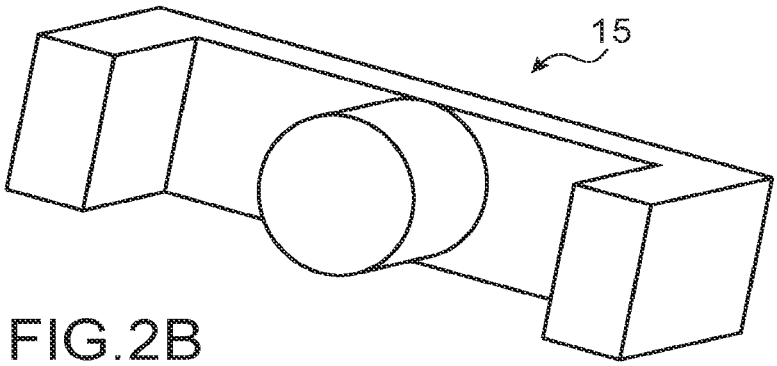
FIG. 2B is a perspective view of a half-core of type E.

In FIGS. 2A and 2B may be seen an example of core for inductor N2 of type E-E. This type of core has great compactness.

The core N2, seen from above in FIG. 2A, comprises a frame 10 of rectangular shape and a central bar 12 of longitudinal axis X' extending perpendicular to the sides of the frame of longest length substantially at their middle. This central bar 12 is intended to be surrounded by the turns of a conductor (not represented). The bar 12 is in the example represented formed of two half-bars separated by an air gap 14.

The core N2 may be formed by assembly of two half-cores 15 of type E as represented in FIG. 2B or be produced directly in a single piece. As a variant, it may be formed by assembly of an E shaped part and an I shaped part or a U shaped part and an additional part.

Figure 5:
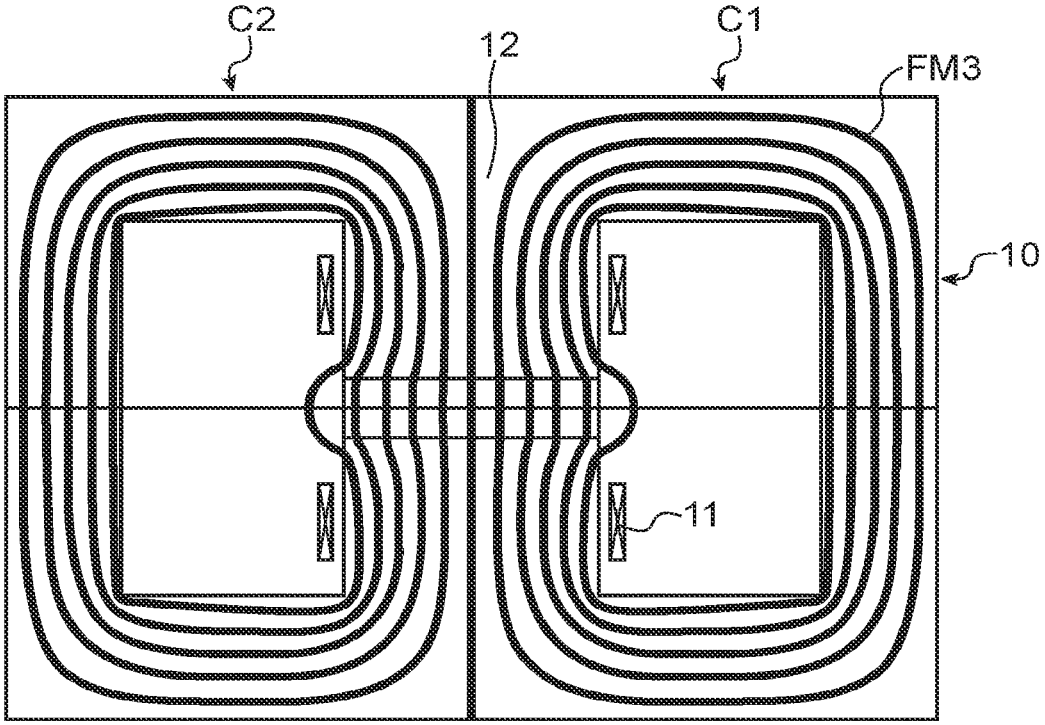
FIG. 5 is a schematic representation of a core of type E-E of the prior art and magnetic flux lines passing through it, the flux lines being generated by a current circulating in a conductor wound around the central bar.

The sides of the frame and the central bar then delimit two magnetic circuits C1 and C2 which are symmetrical with respect to a plane passing through the X axis of the central bar 12 and perpendicular to a mean plane of the frame. The two circuits are of rectangular shape. The magnetic circuits C1 and C2 are intended to be flowed through by magnetic flux lines generated by the circulation of current in the conductor 11, looping back at the level of the air gap. The magnetic flux lines are designated by FM3 in FIG. 5.

The core N2 also comprises magnets A1, A2, A3, A4, A5, A6, A7, A8 arranged in each of the magnetic circuits C1 and C2. The magnets A1 and A5 are situated in the central bar 12 and are common to the two magnetic circuits.

The two magnetic circuits are similar structures, and only the circuit C1 will be described in detail.

The magnetic circuit C1 comprises straight portions 16.1, 16.2, 16.3, 16.4, 16.5. The portions 16.1 and 16.5 being formed by the two half-bars of the central bar 12. The magnets have, in the example represented, the rectangular parallelepiped shape extending over the entire thickness of the core, the thickness of the core being considered in a direction perpendicular to the mean plane of the core.

The magnet A2 extends over practically the entire length of the portion 16.2.

The magnet A3 extends over practically the entire length of the portion 16.3.

The magnet A4 extends practically over the entire length of the portion 16.4.

The magnets A1 and A5 extend over practically the entire length of the portions 16.1 and 16.5 respectively.

The magnets A1 to A5 have an exterior lateral face and an interior lateral face, the interior and the exterior being considered with respect to the interior and the exterior of the magnetic circuit C1.

As a variant, several aligned magnets could be implemented instead of a single magnet in each portion.

The magnets also form a frame open uniquely at the level of the air gap.

In the example represented, the magnets are arranged in the ferromagnetic material such that ferromagnetic material covers the interior and exterior faces of the magnets, and extends continuously between the pole N and pole S of two successive magnets. The magnets, in the example represented and in a preferred manner, extend throughout the thickness of the core and are flush with the front and rear faces of the core, the front and rear faces of the core being the faces parallel to the mean plane of the core. As will be described hereafter, the core may be produced by moulding of a ferromagnetic material, cavities for the magnets being arranged during the moulding.

In the example represented, the width of magnetic material considered in the direction of the X axis for the portions 16.2 and 16.4 of the side of the interior faces of the magnets is greater than that of the side of the exterior faces, but this is not limiting, the same thickness could be provided. This non-symmetrical arrangement of the magnets makes it possible to transfer the connecting zones between magnets to the level of the deflectors, into the corners of the frame. The looping back of the flux on each magnet takes place in a not very active zone of the inductor and does not affect its operation.

Furthermore, the magnets are arranged with respect to each other such that the pole N of a magnet is facing or near to a pole S of a following magnet.

Moreover, the magnetic circuit C1 advantageously comprises deflectors between the poles of successive magnets for guiding the magnetic flux from one magnet to the other, and isolate the magnetic flux circulating in the magnets from that circulating in the ferromagnetic material.

The deflectors comprise for example non-magnetic zones 18 situated near to two poles of two successive magnets, more particularly they are in contact with the two successive magnets in the interior of a frame defined by the magnets.

The zones 18 advantageously comprise cavities 19 produced in the thickness of the core and emerging in the two faces of the core parallel to the mean plane of the core. The cavities 19 may be left empty and contain air, enabling an evacuation of heat to the exterior of the core. In one particularly advantageous embodiment, the cavities 19 are filled with a non-magnetic, non-electrically conducting material offering good thermal conductivity, said material draining heat to the exterior of the core. The cavities are for example filled with AlN.

Preferably, the deflectors have at least the same dimension as the thickness of the magnets.

The effect of the presence of magnets on the magnetic circuit C1 will now be described.

A magnetic flux FM1 flows in the magnet A1 from the pole S to the pole N, the flux comes out of the magnet A1 via the pole N. Due to the presence of a non-magnetic zone 18, a part of the magnetic flux enters into the magnet A2 via the pole S after having circulated in the ferromagnetic material. Indeed, the cavity 19 prevents the magnetic flux lines from looping back directly to the pole S of the magnet A1 in the ferromagnetic material of the portion 16.1 and contributes to the homogeneity of the flux.

The magnetic flux next flows in the magnet A2 to the pole N, joins the pole S of the magnet A3, notably due to the cavity 19, then the magnet A4 and finally through the magnet A5, comes out via its pole N and due to the air gap which forms a non-magnetic deflector, the magnetic flux then flows in the opposite direction in the portions 16.5, 16.4, 16.3, 16.2 and 16.1 and closes the circuit at the level of the pole S of the magnet A1. The magnetic flux circulating in the ferromagnetic material is designated FM2. Thanks to the cavities 19, the magnetic flux FM2 cannot loop back on the magnets A5, A4, A3, A2.

The magnetic circuits C1 comprise two magnetic branches, one formed by the network of magnets and the other by the ferromagnetic material lining the magnets.

In this advantageous exemplary embodiment, the magnetic flux generated by the magnets and flowing in the magnetic material FM2 is continuous over the entire length of the magnetic path of the core. Moreover, the magnets extending throughout the thickness of the ferromagnetic material, the magnetic flux is homogenous over the entire thickness of the ferromagnetic material. A homogeneous polarisation of the magnetic circuit C1 is then obtained. It could be provided that the magnets do not extend over the entire thickness of the core, the polarisation would be less homogenous but the continuous component of the induction would however be reduced.

It should be noted that a part of the magnetic flux coming out of the pole N loops back directly with the south pole of the same magnet via the exterior ferromagnetic material. This part of the flux which loops back via the exterior of the magnet is directed in the same direction as the flux in the interior part, it thus contributes to the continuous polarisation of the exterior part.

In the example represented, the cavities have a square or rectangular section but it could be provided that they have another shape for example an arc of circle section extending between two successive magnets.

As a variant, all the magnets could be replaced by a single magnet in a single piece forming an open frame at the level of the air gap, which would make it possible not to have to produce non-magnetic cavities. As a variant, only part of the magnets could be produced in a single piece, for example the magnets A2 and A3 or A2, A3 and A4, etc.

A flow of magnetic flux FM2 is established in the same way in the magnetic circuit C2.

A magnetic flux is thus generated in a homogeneous manner throughout the core.

In the example represented, the magnets A1 and A5 are common to the two magnetic circuits, but it could be provided to have magnets dedicated to the first magnetic circuit C1 and magnets dedicated to the second magnetic circuit C2.

When a current flows in the conductor 11 surrounding the central bar 12, a magnetic field FM3 is generated, a magnetic flux flows in the two magnetic circuits and generates a variable induction having a continuous component and a variable component (relation I).

By choosing and by orienting the magnets such that the magnetic flux generated cancels the continuous component of the induction generated by the conductor in the core, it is possible to reduce the peak value of the induction generated in the core and magnetic losses, and thus the heating of the core. The orientation of the magnets and the circulation of the current in the conductor are such that the magnetic flux FM2 and the magnetic flux FM3 (in dotted lines in FIG. 2A) generated by the conductor have opposite directions.

The present invention applies to any form of core for inductor, for example said core could have a U shape, the magnets extending in the bottom of the U and in the two branches of the U, the magnetic flux FM2 looping back at the level of the free ends of the branches of the U.

Preferably, the magnets are made of non-electrically conducting material to reduce the risks of couplings and the appearance of Foucault currents at high frequency which would cause heating of the core.

Advantageously, the magnets are magnets of bonded or plastomagnet type. For example, the magnets comprise magnetic powders dispersed in a polymer matrix or an electrically insulating resin. They may advantageously be moulded according to complex shapes. These magnets then have very high electrical resistivity. The bonded magnets may be of NdFeB type with a value of BHmax=10 MGOe. As a variant, the magnets could be made of SmCo, ferrite or SmFeN.

According to an alternative of the core of FIG. 1A, the magnet 6 could be replaced by several magnets aligned such that the pole N of a magnet is facing the pole S of the other magnet. Moreover, deflectors could be provided at the level of the facing poles to avoid the magnetic flux lines coming out of the pole N of a magnet looping back directly to the pole S of the magnet instead of joining the facing pole S.

An example of dimensioning will now be given.

Figure 3:
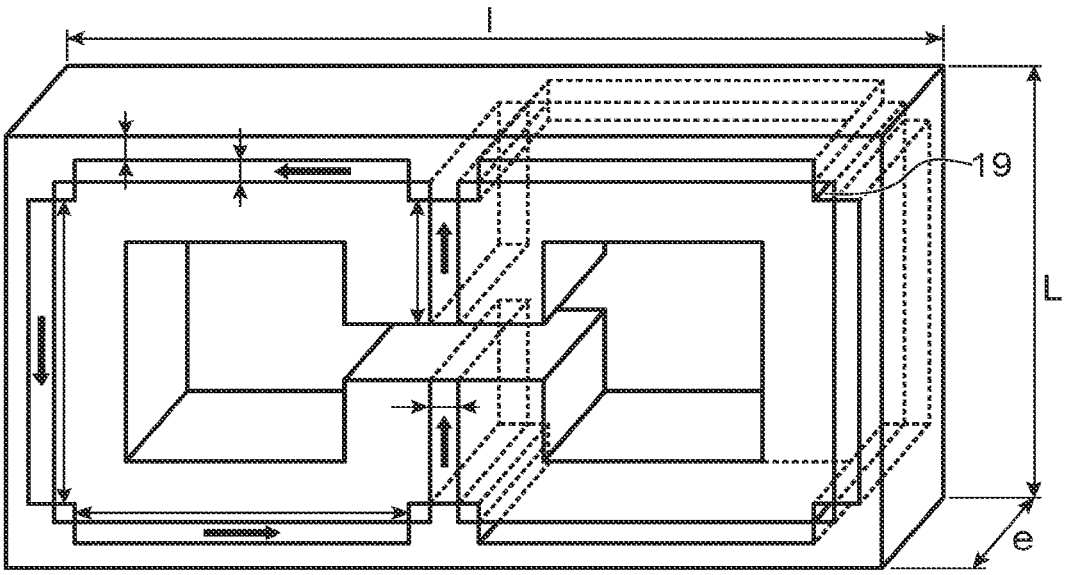
FIG. 3 is a perspective view of an inductor core according to the example of FIG. 2A, FIGS. 4A and 4B are graphic representations of the change in magnetic induction B in mT for an inductor core of the prior art and the inductor core of FIG. 3 respectively as a function of time t in ms.

In FIG. 3 may be seen the core of FIG. 2A in perspective. A core comprising NiZ as ferromagnetic material is considered.

The core has an exterior length I equal to 46 mm, an exterior width L equal to 30 mm, a thickness equal to 11 mm. The sides of the frame have a width equal to 6 mm, the central bar 12 has a width equal to 12 mm and the air gap is equal to 3 mm.

The magnets are parallelepiped and all have a thickness of 11 mm. The magnets A1 and A5 have a length of 10 mm and a width of 2.4 mm. The magnets A3 and A7 have a length of 23 mm and a width of 1 mm. The magnets A2, A4, A6 and A8 have for dimensions a length of 17 mm and a width of 1 mm.

The eight cavities 19 have a square section of 1 mm×1 mm and a height of 11 mm and are filled with air.

This core makes it possible for example to produce a boost chopper converter having the following characteristics: P=1 kW, F=5 MHz, D=0.5, Ve=200 V, r=0.4; Ve being the input voltage of the converter, D the cyclic ratio of the converter (fraction of the cycle where the switch is closed) and r the ripple ratio of the current DI/Idc.

For the magnet, the residual induction is Br=0.7 T and for the current the average continuous value Idc=5 A and the ripple DI=2 A.

Figure 4A:
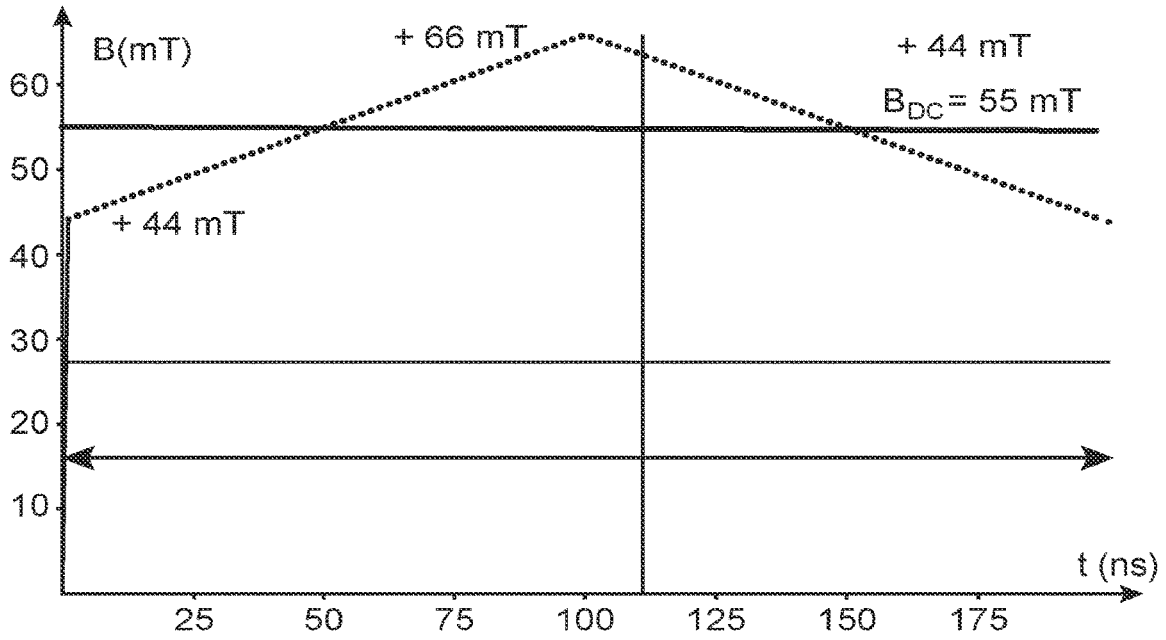

In FIG. 4A may be seen the variation in the magnetic induction B in mT generated by the current circulating in the conductor during a cycle as a function of time t in ns in a core of type E-E of the prior art, i.e. without magnet, made of NiZn and having the same dimensions as the core of FIG. 3

Figure 4B:
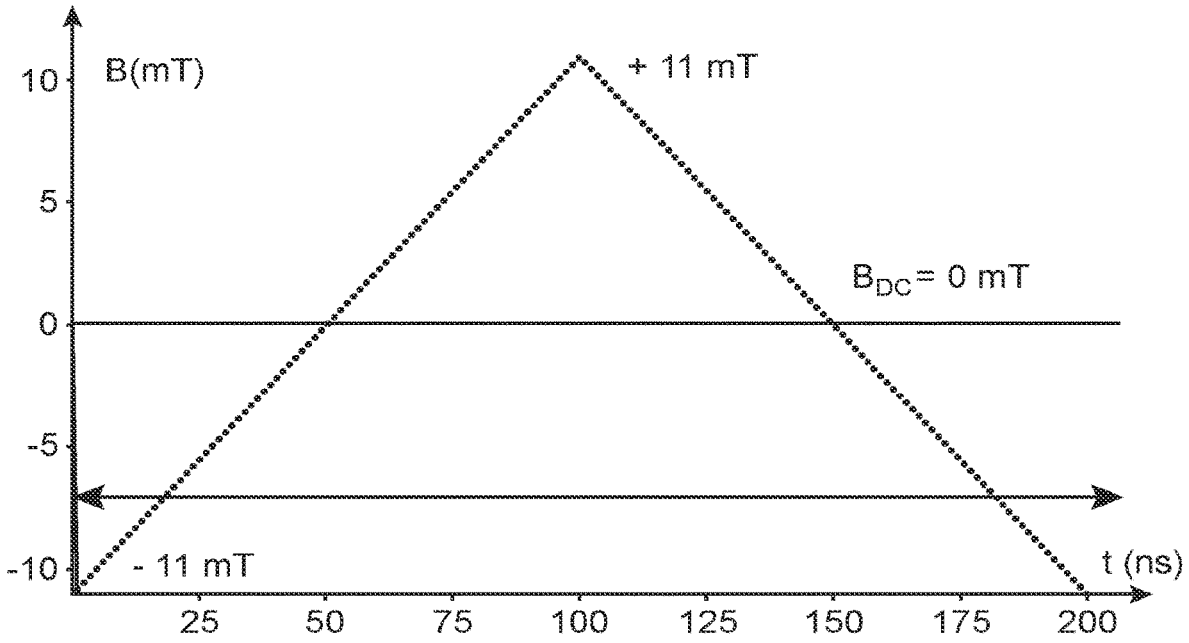

In FIG. 4B may be seen the variation in the magnetic induction B in mT resulting from the polarisation by the magnets in a core of FIG. 3 during a cycle as a function of time t in ns.

In FIG. 4B, it may be noted that the continuous component BDC is equal to 0, whereas without polarisation this continuous component equals 55 mT (FIG. 4A). The variable component varies in the two cases by 22 mT. The peak value of the induction is thus reduced by 55 mT in the core of the invention, which makes it possible to reduce heating of the core substantially. For example, in the case of a core of NiZn type the losses dissipated per unit volume of the core Pd are reduced by a factor 10 and the dissipated power may be evacuated by simple natural convection from the surface of the core.

An example of method for producing a core according to the invention will now be described.

The inductor cores according to the invention may be very advantageously produced by powder injection moulding (PIM).

In a PIM method, the first step consists in obtaining a feedstock suited to the targeted application. The feedstocks are constituted of a mixture of organic matter (polymeric binder) and inorganic powders (metallic or ceramic) that are going to constitute the final part. Next, the feedstock is injected as a thermoplastic material in an injection press according to a technology known to those skilled in the art. The moulding makes it possible to melt the polymers injected with the powder in a cavity and to give the desired shaped to the mixture. During cooling the mixture solidifies and conserves the shape given by the mould.

After demoulding, the part is subjected to different heat or chemical treatments in order to remove the organic phases. The elimination of the organic phase during this step, called debinding, leaves room for 30% to 50% porosity in the blank.

An example of a method of preparation of a feedstock and debinding in the case of manufacture by PIM is described in the document U.S. Pat. No. 8,940,816 B2.

At the end of the debinding the porous blank only contains the powders of the inorganic material. This blank is next densified to form the final dense part. The consolidation of the porous blanks is carried out by sintering at high temperature, preferably at a temperature above 1000° C., carried out in ovens operating under an atmosphere adapted to the type of material used. When the optimum density is reached, the part is cooled to ambient temperature.

Preferably, to produce the cores according to the invention, powders of spinel ferrites of type NiZn or MnZn mixed with organic matter are used to produce the feedstock. Ferrite powders are for example elaborated by solid or chemical synthesis. Solid synthesis comprises the steps of carrying out a grinding of precursor oxides and synthesis of the spinel phase by a heat treatment between 800° C. and 100° C. of the ground powders. The powders are again ground and sieved to obtain a particle size of the order of 10 μm to 20 μm. For the spinel ferrites NiZn and MnZn, the sintering may be carried out under air according to operating conditions well known to those skilled in the art on this type of material.

As a variant, other mild ferromagnetic materials may be used to produce the feedstock. These materials are for example shaped by metallurgy of powders, such as magnetic alloys based on Fe (Fe—Si, Fe—Co, Fe—Ni).

After preparation of the feedstock, said feedstock is shaped in a mould.

To produce the core of FIG. 3, the mould is such that it forms the cavities 18 and the cavities intended to house the magnets.

Preferably, the core of type E-E is produced in two or more symmetrical parts moulded separately and next assembled. The mould comprises removable inserts which are positioned in the mould so as to create, on the moulded part, emerging cavities for the magnets and to form the deflectors.

After moulding the feedstock and cooling the newly created part, a step of debinding of the organic matter takes place. This step takes place for example in an oven by arranging, during the rise in temperature, a maintaining of temperature between for example 400° C. and 700° C.

A sintering in order to densify the core next takes place, said sintering advantageously takes place in the oven used for the debinding. Thus, it is possible to carry out sintering directly after debinding by continuing the rise in temperature to the value recommended for the magnetic phase considered. Debinding takes place for example at 1220° C.

During a following step, the magnets are introduced into the cavities. The magnets may be bonded magnets manufactured beforehand. They are for example moulded and magnetised according to the dimensions adapted to the polarisation of the core. The bonded magnets may be of any type, for example NdFeB, SmCo, SmFeN, hexaferrites. The polymer matrix, in which the magnetic powders are dispersed, is chosen so as to be compatible with the operating temperature of the inductor, for example it is comprised between 100° C. and 150° C. The magnets may be maintained in the cavities by means of an adhesive able to withstand the operating temperature.

During a following step, it is possible to provide to fill the cavities 16 with a non-magnetic, non-electrically conducting and good heat conducting material, such as AlN. For example, the filling material is shaped beforehand by extrusion or moulding then introduced into the cavities 16 in a manner similar to the mounting of the magnets. This step of filling of the cavities 16 may not take place, the cavities filled with air being kept.

The AlN may also be maintained in the cavities by means of an adhesive able to withstand the operating temperature.

According to another example of method, it is possible to provide to produce the inductor core by over-moulding of the ferromagnetic material around the magnets and potentially elements forming the non-magnetic zones. The sintering step may be omitted. Advantageously, the ferromagnetic material may also be over-moulded on the conductor with n turns.

The invention claimed is:

1. An inductor core for magnetic inductor, comprising:

a body comprising a ferromagnetic material and one or more magnets, in which the one or more magnets at least partially form a first path for circulating magnetic flux lines produced by the one or more magnets such that the first path comprises at a first end a designated end south pole, and at a second end a designated end north pole, and wherein the ferromagnetic material at least partially forms a second path for circulating the magnetic flux lines, wherein the ferromagnetic material extends continuously from the south pole to the north pole along the one or more magnets, and comprising, facing the end south pole, a non-magnetic zone and, facing the end north pole, a non-magnetic zone forcing the magnetic flux lines coming out of the end north pole to take the second path and to loop back on the end south pole, the non-magnetic zones being designated end non-magnetic zones, such that a transversal section of the inductor core, perpendicular to the flux lines, comprises both the first path for circulating and the second path for circulating, wherein each of the one or more magnets is disposed in a cavity of the body such that a lateral face of each magnet is at least partly surrounded by ferromagnetic material of the body.

2. An inductor core according to claim 1, wherein each of the one or more magnets comprises an exterior lateral face between the south pole and the north pole, the ferromagnetic material being in contact with at least a part of the exterior lateral surface of each of the one or more magnets.

3. An inductor core according to claim 1, wherein the south pole and the north pole of the first path belong to a single magnet.

4. An inductor core according to claim 3, wherein the ferromagnetic material completely surrounds the lateral face of each of the one or more magnets, the inductor core comprising two end faces comprising for one the south pole and ferromagnetic material and for the other the north pole and ferromagnetic material, each end face facing a non-magnetic zone designated end non-magnetic zones.

5. An inductor core according to claim 4, wherein the ferromagnetic material forms a sleeve receiving the one or more magnets and in contact with the exterior lateral surface of the one or more magnets, and wherein distance between the poles of the one or more magnets and magnetic length of the core are equal or substantially equal, the end non-magnetic zones being formed by air.

6. An inductor core according to claim 1, wherein the south pole and the north pole of the first path belong to distinct magnets, the distinct magnets being arranged such that the poles of opposite polarities of two successive magnets are facing or substantially facing.

7. An inductor core according to claim 6, wherein the poles facing two magnets are connected by zones of ferromagnetic material.

8. An inductor core according to claim 6, wherein the body comprises at least one non-magnetic zone, designated an intermediate non-magnetic zone, at a level of each zone of ferromagnetic material separating the poles facing two magnets to prevent the magnetic flux lines coming out of a north pole of a magnet from looping back directly to the south pole of the magnet without preventing the magnetic flux lines from passing from one pole to the other of two successive magnets.

9. An inductor core according to claim 8, wherein each intermediate non-magnetic zone comprises a cavity.

10. An inductor core according to claim 9, wherein the cavity emerges in opposite exterior faces of the body.

11. An inductor core according to claim 10, wherein the cavity is filled with a heat conducting and electrically insulating material.

12. An inductor core according claim 6, wherein the body has a given thickness, the magnets extending over an entire thickness of the body.

13. An inductor core according to claim 6, wherein the body comprises a rectangular frame and a central bar arranged transversally with respect to sides of the frame of longest length and parallel to sides of the frame of smallest length, and wherein two first paths are delimited in the frame and in the central bar in a symmetrical manner with respect to a plane of symmetry passing through the central bar and perpendicular to a mean plane of the frame, and two second paths are delimited in the frame and in the central bar in a symmetrical manner with respect to the plane of symmetry and in which the central bar comprises an air gap.

14. An inductor core according to claim 13, wherein each side of longer length comprises two magnets of same length and each side of smaller length comprising one magnet, and wherein the central bar comprises a magnet on each side of the air gap, such that the two first paths each comprise five magnets.

15. An inductor core according to claim 6, wherein an air gap is arranged between the end south pole and the end north pole and forming the end non-magnetic zones.

16. An inductor core according to claim 1, wherein the ferromagnetic material has a permeability less than 100.

17. An inductor core according to claim 1, wherein the ferromagnetic material is a spinel ferrite selected from NiZn or MnZn.

18. An inductor comprising an inductor core according claim 1 and a conductor wound around at least one part of the core.

19. A converter comprising at least one electronic component and at least one inductor according to claim 18.

20. A method for manufacturing an inductor core according to claim 1, comprising:

a) supplying at least one magnet;

b) manufacturing a body made of ferromagnetic material by injection molding from a feedstock comprising at least one ferromagnetic powder and organic matter, to arrange at least one cavity for mounting of the magnet in the body, c) mounting the magnet in the cavity.

21. A method for manufacturing according to claim 20, wherein during b), at least one cavity is produced to form a non-magnetic zone and comprising putting in place a non-magnetic, non-electrically conducting and heat conducting material in the cavity forming the non-magnetic zone.

22. A method for manufacturing according to claim 20, wherein during a), the magnet is a bonded magnet and the magnet is produced by molding a mixture of at least one magnetic powder and a polymer matrix.

23. A method for manufacturing according to claim 20, wherein b) comprises molding the feedstock, debinding, and heat treating.

* * * * *